US007619948B2

(12) United States Patent
Takasawa

(10) Patent No.: US 7,619,948 B2
(45) Date of Patent: Nov. 17, 2009

(54) TIMEPIECE DIAL AND TIMEPIECE

(75) Inventor: Koki Takasawa, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 191 days.

(21) Appl. No.: 11/480,397

(22) Filed: Jul. 5, 2006

(65) Prior Publication Data

US 2007/0008828 A1 Jan. 11, 2007

(30) Foreign Application Priority Data

Jul. 6, 2005 (JP) ..... 2005-198106
Apr. 25, 2006 (JP) ..... 2006-121278

(51) Int. Cl.
*G04B 19/06* (2006.01)

(52) U.S. Cl. ..... 368/232; 368/234

(58) Field of Classification Search ..... 368/232, 368/205, 228, 234
See application file for complete search history.

(56) References Cited

U.S. PATENT DOCUMENTS

| | | | | |
|---|---|---|---|---|
| 5,426,621 | A * | 6/1995 | Akasaka | 368/226 |
| 6,278,660 | B1 * | 8/2001 | Tognazzini | 368/21 |
| 6,982,931 | B2 * | 1/2006 | Brewer et al. | 368/80 |
| 2004/0032797 | A1 * | 2/2004 | Sato et al. | 368/232 |
| 2005/0185518 | A1 * | 8/2005 | Kawakami et al. | 368/232 |
| 2006/0034161 | A1 * | 2/2006 | Muller | 368/281 |

FOREIGN PATENT DOCUMENTS

| | | | |
|---|---|---|---|
| EP | 0639470 | A1 | 2/1995 |
| EP | 0831537 | A2 | 3/1998 |
| EP | 1184911 | A1 | 3/2002 |
| JP | S56-162074 | A | 12/1981 |
| JP | U-S61-170087 | | 10/1986 |
| JP | 2000-125912 | A | 5/2000 |
| JP | 2000-292556 | A | 10/2000 |
| JP | 2001-13267 | A | 1/2001 |
| JP | 2001-296373 | A | 10/2001 |
| JP | 2002-214365 | A | 7/2002 |
| JP | 2003-239083 | A | 8/2003 |
| JP | 2005-227046 | A | 8/2005 |
| JP | 2005-274347 | A | 10/2005 |

* cited by examiner

*Primary Examiner*—Vit W Miska
(74) *Attorney, Agent, or Firm*—Global IP Counselors, LLP

(57) ABSTRACT

A timepiece dial which is transmissive to electromagnetic waves (radio waves, light) and is superior in terms of aesthetic appearance and durability, and to provide a timepiece equipped with this timepiece dial. The timepiece dial of the present invention has a glass fiber sheet primarily composed of glass fibers, a first film disposed on the side of a first face constituting one of the principal faces of the glass fiber sheet, and a second film disposed on the side of a second face constituting the other principal face of the glass fiber sheet. Furthermore, the glass fiber sheet has a first region which is disposed in the vicinity of the surface of the first face and which is penetrated by at least a portion of the first film, a second region which is disposed in the vicinity of the surface of the second face and which is penetrated by at least a portion of the second film, and a third region which is disposed between the first region and second region and which is penetrated neither by the first film nor by the second film.

21 Claims, 3 Drawing Sheets

TIMEPIECE DIAL AND TIMEPIECE

TECHNICAL FIELD

This application claims priority to Japanese Patent Application Nos. 2005-198106 and 2006-121278. The entire disclosure of Japanese Patent Application Nos. 2005-198106 and 2006121278 is hereby incorporated herein by reference.

The present invention relates to a timepiece dial and a timepiece.

BACKGROUND ART

Timepiece dials must have superior visual recognition characteristics as practical products, and a superior aesthetic appearance as decorative products. Conventionally, in order to achieve such objects, metal materials such as Au, Ag, and the like have generally been used as the constituent materials of timepiece dials.

On the other hand, in order to lower production costs, increase the degree of freedom of molding of the timepiece dial, and the like, there have been attempts to use plastics as a substrate, and to form coating films composed of metal materials on the surface of such a substrate (for example, see Patent Reference 1).

However, plastics are generally inferior in terms of adhesion to metal materials. Accordingly, peeling tends to occur between the substrate and the coating film, so that the problem of inferiority of the timepiece dial in terms of durability has been encountered.

Furthermore, for example, in the case of radio-controlled timepieces and solar timepieces (timepieces equipped with solar cells), the ability to transmit electromagnetic waves (radio waves, light) is required in the timepiece dial. Accordingly, although plastics have been used in such timepiece dials, the external appearance of plastics lacks refinement. Consequently, in order to improve the aesthetic appearance of such timepiece dials, attempts have been made to coat such timepiece dials with thin films composed of metal materials. However, as was described above, the following problem has been encountered; namely, plastics are inferior in terms of adhesion to metal materials. Furthermore, in order to increase the transmissivity with respect to electromagnetic waves (radio waves, light), it is necessary to make the film sufficiently thin. In this case, however, the following problem is encountered; namely, if the film is made sufficiently thin, the aesthetic appearance of the timepiece dial as a whole is adversely affected.

[Patent Reference 1] Japanese Patent Application Laid-Open No. 2003-239083 (page 4, left column, lines 37 through 42).

DISCLOSURE OF THE INVENTION

Problems which the Invention is Intended to Solve

It is an object of the present invention to provide a timepiece dial which has the ability to transmit electromagnetic waves (radio waves, light), and which is superior in terms of aesthetic appearance and durability, and to provide a timepiece that is equipped with this timepiece dial.

Means Used to Solve the Above-Mentioned Problems

Such an object is achieved by means of the following inventions: The timepiece dial of the present invention has: a first film being transmissive to electromagnetic waves, a second film being transmissive to electromagnetic waves, having a time display face; and a glass fiber sheet primarily made of glass fibers, being transmissive to electromagnetic waves, having a first region being configured next to the first film which at least partially penetrates to the glass fiber sheet, a second region being configured next to the second film which at least partially penetrates to the glass fiber sheet, and a third region being configured between the first and second region.

As a result, the present invention can provide a timepiece dial which has the ability to transmit electromagnetic waves (radio waves, light), and which is superior in terms of aesthetic appearance and durability.

In the timepiece dial of the present invention, it is preferable that the thickness of the abovementioned first film be 50 to 300 μm.

As a result, the aesthetic appearance and durability of the timepiece dial can be made especially good while sufficiently high transmissivity is maintained with respect to electromagnetic waves (radio waves, light).

In the timepiece dial of the present invention, it is preferable that the abovementioned first film be a film in which a first part constituting a region that penetrates into the glass fiber sheet is composed of a material containing a tacky/adhesive agent component, and a second part constituting a region located further toward the outside surface than the first part is composed of a material containing at least one substance selected from the group consisting of polycarbonates (PC), acrylic resins, and acrylonitrile-butadiene-styrene copolymers (ABS resins).

As a result, the transmissivity with respect to electromagnetic waves (radio waves, light) can be made especially high while the aesthetic appearance of the timepiece dial is kept at a sufficiently high level. Furthermore, the adhesion between the first film and the glass fiber sheet can be made especially high, and the durability of the timepiece dial can also be made especially high.

In the timepiece dial of the present invention, it is preferable that the thickness of the abovementioned second film be 50 to 300 μm.

As a result, the aesthetic appearance and durability of the timepiece dial can be made especially good while sufficiently high transmissivity is maintained with respect to electromagnetic waves (radio waves, light).

In the timepiece dial of the present invention, it is preferable that the abovementioned second film be a film in which a third part constituting a region that penetrates into the glass fiber sheet is composed of a material containing a tacky/adhesive agent component, and a fourth part constituting a region located further toward the outside surface than the third part is composed of a material containing at least one substance selected from the group consisting of polycarbonates (PC), acrylic resins, and acrylonitrile-butadiene-styrene copolymers (ABS resins).

As a result, the transmissivity with respect to electromagnetic waves (radio waves, light) can be made especially high while the aesthetic appearance of the timepiece dial is kept at a sufficiently high level. Furthermore, the adhesion of the second film and glass fiber sheet can be made especially high, and the durability of the timepiece dial can be made especially high as well.

In the timepiece dial of the present invention, it is preferable that the thickness of the abovementioned glass fiber sheet be 30 to 500 μm.

As a result, the transmissivity with respect to electromagnetic waves (radio waves, light) can be made especially high while a sufficiently good aesthetic appearance and durability of the timepiece dial are maintained.

In the timepiece dial of the present invention, it is preferable that the thickness of the abovementioned glass fibers be 1 to 20 μm.

As a result, the aesthetic appearance of the timepiece dial can be made especially good while sufficiently high transmissivity is maintained with respect to electromagnetic waves (radio waves, light). Furthermore, the adhesion of the glass fiber sheet to the first film and second film can be made especially high. The mechanical strength (stability with respect to deformation) and the like of the timepiece dial can also be made especially high. As a result, the durability of the timepiece dial is also especially high.

In the timepiece dial of the present invention, it is preferable that the refractive index of the constituent material(s) of the abovementioned glass fibers be 1.40 to 1.70.

The aesthetic appearance of the timepiece dial can thereby be made particularly good while sufficiently high transmissivity is maintained with respect to electromagnetic waves (radio waves, light).

In the timepiece dial of the present invention, it is preferable that the surface density of the abovementioned glass fiber sheet be 20 to 500 g/m$^2$.

The aesthetic appearance of the timepiece dial can thereby be made particularly good while sufficiently high transmissivity is maintained with respect to electromagnetic waves (radio waves, light). Furthermore, the adhesion of the glass fiber sheet to the first film and second film can be made especially high, and the mechanical strength (stability with respect to deformation) and the like of the timepiece dial can also be made especially high. As a result, the durability of the timepiece dial is also especially high.

In the timepiece dial of the present invention, it is preferable that the thickness of the timepiece dial be 300 to 700 μm.

The aesthetic appearance and durability of the timepiece dial can thereby be made particularly good while sufficiently high transmissivity is maintained with respect to electromagnetic waves (radio waves, light)

In the timepiece dial of the present invention, it is preferable that the thickness of the abovementioned first region be 0.1 to 140 μm.

The adhesion between the glass fiber sheet and the first film can thereby be made especially high while the aesthetic appearance of the timepiece dial is kept at a sufficiently high level, so that the durability of the timepiece dial can be made especially high.

In the timepiece dial of the present invention, it is preferable that the thickness of the abovementioned second region be 0.1 to 140 μm.

The adhesion between the glass fiber sheet and the second film can thereby be made especially high while the aesthetic appearance of the timepiece dial is kept at a sufficiently high level, and the durability of the timepiece dial can also be made especially high.

In the timepiece dial of the present invention, it is preferable that the thickness of the third region be 5 to 280 μm.

The aesthetic appearance of the timepiece dial can thereby be made sufficiently outstanding while the timepiece dial is kept sufficiently durable.

It is preferable that the timepiece dial of the present invention be a dial for a radio-controlled timepiece.

The timepiece dial of the present invention is superior in terms of aesthetic appearance and durability, and is also superior in terms of transmissivity with respect to electromagnetic waves (radio waves). Accordingly, the timepiece dial of the present invention is ideal for use as the dial of a radio-controlled timepiece.

It is preferable that the timepiece dial of the present invention be a dial for a solar timepiece.

The timepiece dial of the present invention is superior in terms of aesthetic appearance and durability, and is also superior in terms of transmissivity with respect to electromagnetic waves (light). Accordingly, the timepiece dial of the present invention is ideal for use as the dial of a solar timepiece.

It is preferable that the timepiece dial of the present invention be composed of a material containing a coloring agent.

The timepiece dial of the present invention is equipped with a glass fiber sheet. The glass material that constitutes the glass fibers is itself inherently colorless, so that a glass fiber sheet composed of such glass fibers shows a white color. Accordingly, in the present invention, timepiece dials with a broad range of color variations can be provided by using coloring agents.

The timepiece of the present invention is characterized in that this timepiece is equipped with the timepiece dial of the present invention.

As a result, the present invention can provide timepieces that are superior in terms of aesthetic appearance and durability. Furthermore, the present invention can provide timepieces (e.g., radio-controlled timepieces, solar timepieces, radio-controlled solar timepieces, or the like) that can effectively utilize electromagnetic waves from the outside (radio waves, light).

Effect of the Invention

The present invention makes it possible to provide a timepiece dial that has the ability to transmit electromagnetic waves (radio waves, light), and that is superior in terms of aesthetic appearance and durability, and to provide a timepiece that is equipped with this timepiece dial.

PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

<Timepiece Dial>

First, a preferred embodiment of the timepiece dial of the present invention will be described.

Figure 1:
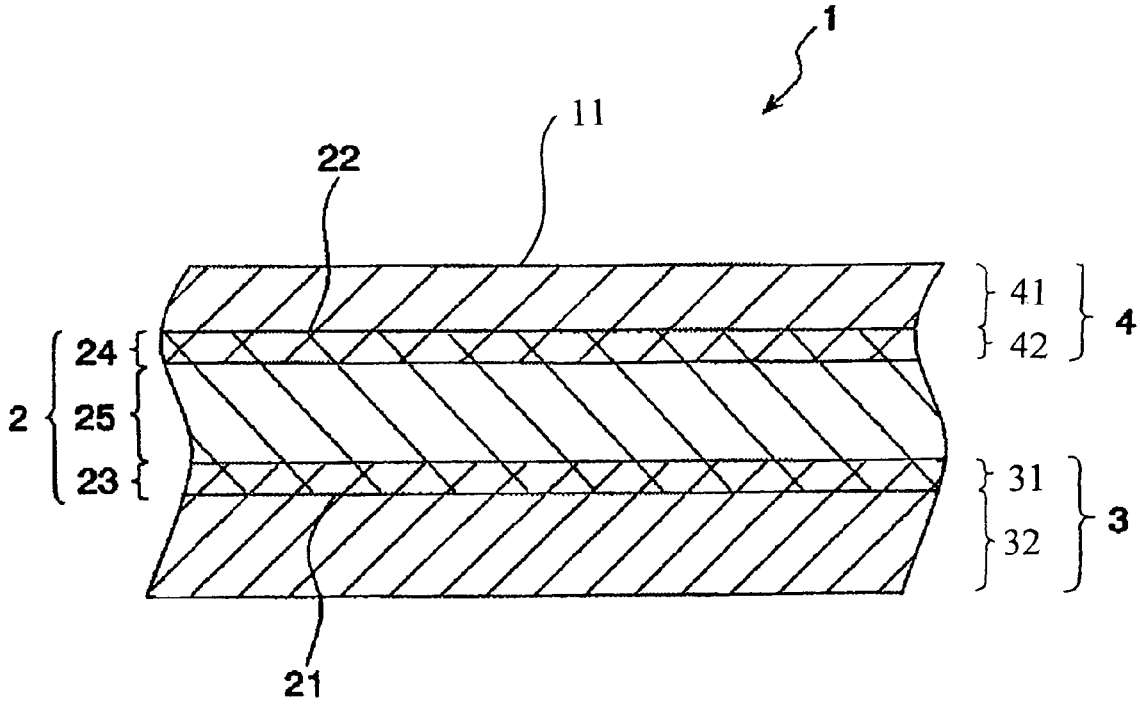
FIG. 1 is a sectional view showing a preferred embodiment of the timepiece dial of the present invention.

FIG. 1 is a sectional view showing a preferred embodiment of the timepiece dial of the present invention.

As is shown in FIG. 1, the timepiece dial 1 has a glass fiber sheet 2, a first film 3, and a second film 4. Ordinarily, in cases where the timepiece dial 1 is used in a timepiece such as that described below, this timepiece dial 1 is used so that the outside face is one of the two faces, i.e., either the face on which the first film 3 is disposed or the face on which the second film 4 is disposed. However, in the following description, a case will be described in which the second film 4 includes a time display face 11 that shows time information.

[Glass Fiber Sheet]

The glass fiber sheet 2 is primarily composed of glass fibers.

Since the glass fiber sheet 2 has the function of scattering and reflecting outside light and the like, this sheet shows a white external appearance having a lustrous feel. The aesthetic appearance of the timepiece dial 1 can be made superior by means of such a glass fiber sheet 2.

Furthermore, as a result of being equipped with this glass fiber sheet 2, the timepiece dial 1 has a solid three-dimensional feel, and thus has a superior external appearance not seen in the past.

Furthermore, the glass material constituting the glass fibers is generally superior in terms of transmissivity with respect to electromagnetic waves (radio waves, light) (i.e., electromagnetic wave transmissivity). Furthermore, since the glass fiber sheet 2 generally has gaps between the individual glass fibers, this sheet has an especially high electromagnetic wave (radio wave, light) transmissivity.

Examples of constituent materials of such glass fibers include soda glass, crystal glass, quartz glass, lead glass, potassium glass, borosilicate glass, alkali-free glass, and the like.

There are no particular restrictions on the refractive index (absolute refractive index) of the constituent materials of the glass fibers. However, a refractive index of 1.40 to 1.70 is preferred, a refractive index of 1.45 to 1.65 is more preferred, and a refractive index of 1.50 to 1.60 is even more preferred. If the refractive index of the constituent materials of the glass fibers is a value within the abovementioned range, the aesthetic appearance of the timepiece dial 1 can be made particularly good while sufficiently high transmissivity is maintained with respect to electromagnetic waves (radio waves, light).

Furthermore, there are no particular restrictions on the thickness of the glass fibers constituting the glass fiber sheet 2. However, a thickness of 1 to 20 μm is preferred, a thickness of 2 to 15 μm is more preferred, and a thickness of 3 to 13 μm is even more preferred. If the thickness of the glass fibers is a value within the abovementioned range, the aesthetic appearance of the timepiece dial 1 can be made particularly good while sufficiently high transmissivity is maintained with respect to electromagnetic waves (radio waves, light). Furthermore, the adhesion of the glass fiber sheet 2 to the first film 3 and second film 4 can be made especially high, and the mechanical strength (stability with respect to deformation) and the like of the timepiece dial 1 can also be made especially high. As a result, the timepiece dial 1 is especially durable. On the other hand, if the thickness of the glass fibers is less than the lower limit of the abovementioned range, the aesthetic appearance of the timepiece dial 1 deteriorates, and the transmissivity with respect to electromagnetic waves (radio waves, light) also decreases. On the other hand, if the thickness of the glass fibers exceeds the abovementioned upper limit, the aesthetic appearance of the timepiece dial 1 deteriorates (in particular, it becomes difficult to obtain an external appearance with a good white feel), and the width of variations in external appearance is narrowed. Furthermore, a tendency is also seen for the adhesion to the first film 3 and second film 4 to decrease.

There are no particular restrictions on the surface density of the glass fiber sheet 2. However, a surface density of 20 to 500 g/m$^2$ is preferred, a surface density of 40 to 400 g/m$^2$ is more preferred, and a surface density of 100 to 300 g/m$^2$ is even more preferred. If the surface density of the glass fiber sheet 2 is a value within the abovementioned range, the aesthetic appearance of the timepiece dial 1 can be made particularly good while sufficiently high transmissivity is maintained with respect to electromagnetic waves (radio waves, light). Furthermore, the adhesion of the glass fiber sheet 2 to the first film 3 and second film 4 can be made especially high, and the mechanical strength (stability with respect to deformation) and the like of the timepiece dial 1 can also be made especially high. As a result, the timepiece dial 1 is especially durable.

There are no particular restrictions on the glass fiber sheet 2. However, a thickness of 30 to 500 μm is preferred, a thickness of 50 to 400 μm is more preferred, and a thickness of 80 to 300 μm is even more preferred. If the thickness of the glass fiber sheet 2 is a value within the abovementioned range, the transmissivity with respect to electromagnetic waves (radio waves, light) can be made especially high while a sufficiently good aesthetic appearance and durability of the timepiece dial 1 are maintained. On the other hand, if the thickness of the glass fiber sheet 2 is less than the abovementioned lower limit value, it may be difficult, depending on the constituent materials of the glass fiber sheet 2 and the like, to keep the aesthetic appearance of the timepiece dial 1 at a sufficiently high level. Furthermore, if the thickness of the glass fiber sheet 2 is less than the abovementioned lower limit value, it is difficult to design the below-described first region 23 and second region 24 with a sufficient thickness. As a result, there is a possibility that it will be difficult to achieve a sufficient increase in the durability of the timepiece dial 1. On the other hand, if the thickness of the glass fiber sheet 2 exceeds the abovementioned upper limit value, the thickness of the timepiece dial 1 as a whole is increased, and this is disadvantageous for reducing the thickness of the timepiece in cases where, for example, this timepiece dial is applied to a timepiece of the type described later. Furthermore, if the thickness of the glass fiber sheet 2 exceeds the abovementioned upper limit value, the transmissivity of the timepiece dial 1 with respect to electromagnetic waves may decrease, depending on the constituent materials of the glass fiber sheet 2 and the like, so that the appropriate application of this timepiece dial to a solar timepiece (timepiece containing a solar cell), radio-controlled timepiece, or the like becomes difficult.

Furthermore, the glass fiber sheet 2 may be composed of any type of woven material such as a flat weave, twill, satin weave, gauze, imitation gauze, or the like. Alternatively, this glass fiber sheet 2 may be a nonwoven fabric that is not woven. In particular, a glass fiber sheet 2 composed of a woven material is particularly preferred, and a sheet composed of a woven material woven in a flat weave is even more preferred. As a result, the aesthetic appearance of the timepiece dial 1 can be made particularly good.

A first film 3 is disposed on the side of the first face 21, which is one of the principal faces of the glass fiber sheet 2. Furthermore, a second film 4 is disposed on the side of the second face 22, which is the other principal face of the glass fiber sheet 2 (i.e., the principal face on the opposite side from the first face 21).

Furthermore, the glass fiber sheet 2 has a first region 23 penetrated by at least a portion of the first film 3 in the vicinity of the surface of the first face 21, and has a second region 24 penetrated by at least a portion of the second film 4 in the vicinity of the surface of the second face 22.

As a result of the surfaces of the glass fiber sheet thus being covered by films, the timepiece dial is superior in terms of mechanical strength. Furthermore, in the present invention, since the films penetrate into portions of the glass fiber sheet in the direction of thickness, the adhesion between the glass fiber sheet and the films is superior. In particular, since the glass fibers are entangled in the glass fiber sheet, an anchoring effect is effectively exhibited as a result of the films penetrating into the spaces between the individual glass fibers, so that the adhesion between the glass fiber sheet and the films is especially high. Accordingly, superior mechanical strength can be stably maintained over a long period of time. Furthermore, since the surfaces of the glass fiber sheet are covered by films (i.e., the first and second films) so that the glass fiber sheet has a construction in which the films penetrate into portions of the glass fiber sheet in the direction of thickness of the glass fiber sheet, the unraveling of the glass fibers that constitute the glass fiber sheet can be effectively prevented. As a result, deterioration in the aesthetic appearance of the timepiece dial caused by the unraveling of the glass fibers can be reliably prevented over a long period of time. Furthermore, any deleterious effect on the movement or the like caused by unraveled glass fibers can be securely prevented, so that the reliability of the timepiece can be made especially high.

The following effects can also be obtained as a result of films being disposed on the surfaces of the glass fiber sheet. Specifically, since the glass fiber sheet is composed of numerous glass fibers, relatively large indentations and projections are inherently present in the surfaces, so that treatments such as printing, typesetting (mounting of hour numerals), affixing of the hour numerals, and the like are difficult to perform. Furthermore, it is difficult to achieve a sufficient increase in the adhesion of such characters; accordingly, application to a timepiece dial has been difficult. However, such treatments can be easily and reliably performed by disposing films on the surfaces of the glass fiber sheet as described above.

Furthermore, such films (films in which at least portions of the films penetrate into portions of the glass fiber sheet in the direction of thickness of the glass fiber sheet) are disposed on both sides of the glass fiber sheet. Accordingly, even in cases where temperature variations or the like occur, it is possible to efficiently prevent the generation of warping or other changes in the timepiece dial caused by differences in the thermal expansion coefficient or the like between the constituent materials of the films and the constituent materials of the glass fiber sheet. Specifically, as a result of films being present on both sides of the glass fiber sheet, the shape of the timepiece dial can be made markedly stable.

The thickness of the first region 23 varies according to the thickness of the glass fiber sheet 2, the thickness of the second region 24, and the like, but is preferably 0.1 to 140 μm, more preferably 0.2 to 80 μm, and even more preferably 0.5 to 30 μm. If the thickness of the first region 23 is a value within the abovementioned range, the adhesion between the glass fiber sheet 2 and first film 3 can be made especially high while the aesthetic appearance of the timepiece dial 1 is kept at a sufficiently high level. The durability (mechanical strength, shape stability, and the like) of the timepiece dial 1 can also be made especially high. On the other hand, if the thickness of the first region 23 is less than the abovementioned lower limit value, it may become difficult, depending on the constituent materials of the first film 3 and the like, to achieve a sufficient increase in the adhesion between the glass fiber sheet 2 and first film 3, so that it becomes difficult to make the timepiece dial 1 sufficiently more durable. Meanwhile, if the thickness of the first region 23 exceeds the abovementioned upper limit value, depending on the thickness of the glass fiber sheet 2, the thickness of the second region 24, and the like, the thickness of the third region 25 described later may decrease, and the aesthetic appearance of the timepiece dial 1 tends to deteriorate.

Furthermore, the thickness of the second region 24 varies according to the thickness of the glass fiber sheet 2, the thickness of the first region 23, and the like, but is preferably 0.1 to 140 μm, more preferably 0.2 to 80 μm, and even more preferably 0.5 to 30 μm. If the thickness of the second region 24 is a value within the abovementioned range, the adhesion between the glass fiber sheet 2 and second film 4 can be made especially high while the aesthetic appearance of the timepiece dial 1 is kept at a sufficiently high level, and the durability (mechanical strength, shape stability, and the like) of the timepiece dial 1 can also be made especially high. On the other hand, if the thickness of the second region 24 is less than the abovementioned lower limit value, it may become difficult, depending on the constituent materials of the second film 4 and the like, to achieve a sufficient increase in the adhesion between the glass fiber sheet 2 and second film 4, so that it becomes difficult to make the timepiece dial 1 sufficiently more durable. Meanwhile, if the thickness of the second region 24 exceeds the abovementioned upper limit value, depending on the thickness of the glass fiber sheet 2, the thickness of the first region 23, and the like, the thickness of the third region 25 described later may decrease, and the aesthetic appearance of the timepiece dial 1 tends to deteriorate.

In addition to the abovementioned first region 23 and second region 24, the glass fiber sheet 2 has a third region (air layer) 25, penetrated neither by the first film 3 nor second film 4, between the first region 23 and second region 24. In the third region 25, the glass fibers that constitute the glass fiber sheet 2 are ordinarily covered by an atmosphere of air or the like. Such an atmosphere generally has a refractive index (approximately 1.001) that is considerably lower than that of the material constituting the glass fibers.

Thus, as a result of the glass fiber sheet having a region (third region) not penetrated by the constituent materials of the films in the direction of thickness, external light can be effectively scattered and reflected, and the aesthetic appearance of the timepiece dial can be made particularly good. On the other hand, when no third region is present, external light cannot be effectively scattered and reflected, so that the superior aesthetic appearance of the glass fiber sheet cannot be obtained. To describe this in greater detail, if there is no third region, the transparence of the timepiece dial itself becomes too high, so that when one face (principal face) of the timepiece dial is viewed, the opposite face (principal face) can be seen via the timepiece dial, thus causing a marked deterioration in the aesthetic appearance of the glass fiber sheet timepiece dial. It is thought that this is attributable to the following causes; namely, the constituent materials of the first film 3 and second film 4 generally have a refractive index that is considerably greater than that of gases such as air or the like, and ordinarily have a refractive index showing little difference from the refractive index of the glass fibers. The scattering and reflection of external light by the glass fibers can therefore be prevented. Furthermore, it is also conceivable that relatively large quantities of coloring agents or the like might be used as constituent materials of the timepiece dial in order to prevent such problems from occurring. In such cases, however, the transmissivity with respect to light markedly decreases, and application to solar timepieces such as those described below becomes impossible. Furthermore, in cases where relatively large amounts of coloring agents are used, the timepiece dial lacks refinement, and is inferior in terms of aesthetic appearance.

There are no particular restrictions on the thickness of the third region 25. However, this thickness is preferably 5 to 280 μm, more preferably 30 to 260 μm, and even more preferably 79 to 245 μm. If the thickness of the third region 25 is a value within the abovementioned range, the aesthetic appearance of the timepiece dial 1 can be made particularly good while the timepiece dial 1 is kept sufficiently durable. On the other hand, if the thickness of the third region 25 is less that the abovementioned lower limit value, there is a possibility that it may become difficult, depending on the constituent materials, thickness, and the like of the second film 4, to keep the aesthetic appearance of the timepiece dial 1 at a sufficiently high level. Meanwhile, if the thickness of the third region 25 exceeds the abovementioned upper limit value, depending on the thickness of the glass fiber sheet 2 and the like, it may become difficult to achieve a sufficient increase in the thicknesses of the first film 23 and second film 24, and it may become difficult to achieve a sufficient increase in the durability of the timepiece dial 1. Furthermore, in cases where the thickness of the third region 25 exceeds the abovementioned upper limit value, it is also conceivable that the thickness of the glass fiber sheet 2 might be increased in order to increase the thicknesses of the first region 23 and second region 24. In such a case, however, the thickness of the timepiece dial 1 as a whole is increased, so that this becomes disadvantageous for obtaining a thin timepiece in the case of application to timepieces such as those described later. Furthermore, the transmissivity of the timepiece dial 1 with respect to electromagnetic waves decreases, and there is a possibility that appropriate application to solar timepieces, radio-controlled timepieces, and the like will become difficult.

[First Film]

The first film 3 may be composed of any type of material. However, it is preferable that this film be composed of a material having high transparency (e.g., a material with a transmissivity of 60% or greater with respect to visible light). In particular, it is especially preferable that this film be composed of organic polymer materials such as various types of plastics or the like. As a result, the transmissivity with respect to electromagnetic waves (radio waves, light) can be made especially high while the aesthetic appearance of the timepiece dial 1 is kept at a sufficiently high level. Furthermore, the adhesion between the first film 3 and glass fiber sheet 2 can be made especially high, and the durability of the timepiece dial 1 can also be made especially high.

Various types of thermoplastic resins and various types of thermosetting resins may be cited as examples of organic polymers that can be used to form the first film 3. Examples of such polymers include polyolefins such as polyethylenes, polypropylenes, ethylene-propylene copolymers, ethylene-vinyl acetate copolymers (EVA), and the like; cyclic polyolefins; modified polyolefins; polyvinyl chlorides; polyvinylidene chlorides; polystyrenes; polyamides (e.g., nylon 6, nylon 46, nylon 66, nylon 610, nylon 612, nylon 11, nylon 12, nylon 6-12, nylon 6-66); polyimides; polyimide-imides; polycarbonates (PC); poly-(4-methylpentene-1); ionomers; acrylic resins; polymethyl methacrylates; acrylonitrile-butadiene-styrene copolymers (ABS resins); acrylonitrile-styrene copolymers (AS resins); butadiene-styrene copolymers; polyoxymethylene; polyvinyl alcohols (PVA); ethylene-vinyl alcohol copolymers (EVOH); polyethylene terephthalates (PET), polybutylene terephthalates (PBT), polycyclohexane terephthalates (PCT), and other polyesters; polyethers; polyether ketones (PEK); polyether ether ketones PEEK); polyether imides; polyacetals (POM); polyphenylene oxides; modified polyphenylene oxides; polysulfones; polyethersulfones; polyphenylene sulfides; polyallylates, aromatic polyesters (liquid crystal polymers); polytetrafluoroethylenes, polyvinylidene fluorides, and other fluororesins; various types of thermoplastic elastomers such as styrene type, polyolefin type, polyvinyl chloride type, polyurethane type, polyester type, polyamide type, polybutadiene type, trans-polyisoprene type, fluororubber type, chlorinated polyethylene type, and the like; epoxy resins; phenol resins; urea resins; melamine resins; unsaturated polyesters; silicone resins; urethane resins; poly-p-xylylene resins such as poly-p-xylylene, poly-monochloro-p-xylylene, poly-dichloro-p-xylylene, poly-monofluoro-p-xylylene, poly-monoethyl-p-xylylene, and the like; and copolymers, blends, polymer alloys, and the like composed chiefly of these polymers. Among these, single polymers, or combinations of two or more polymers (e.g., as blended resins, polymer alloys, or the like) can be used.

Furthermore, the first film 3 may be a laminate having a plurality of layers, or a material whose composition successively varies in the direction of thickness (graded material). As a result of the first film 3 having such a construction, for example, the advantages of a plurality of different types of materials constituting the first film 3 can be obtained more effectively. In more concrete terms, for example, a combination of a material constituting a portion (first part) that penetrates into the glass fiber sheet 2 and a material constituting a portion (second part) that does not penetrate into the glass fiber sheet 2 can be selected for the first film 3. In this case, the durability (shape stability, mechanical strength, and the like) of the timepiece dial 1 can be made especially high while maintaining a sufficiently high adhesion of the first film 3 to the glass fiber sheet 2.

In cases where the first film 3 has the abovementioned construction (laminate or graded material), it is preferable that the region (first part) that penetrates into the glass fiber sheet 2 be composed of a material containing a tacky/adhesive agent component (tackifying agent or adhesive agent), and that the region (second part) that is located further toward the outside surface than the abovementioned region be composed of a material containing at least one substance selected from the group consisting of polycarbonates (PC), acrylic resins, and acrylonitrile-butadiene-styrene copolymers (ABS resins). If the first film 3 is composed of such a material, the abovementioned effects can be displayed even more prominently.

Furthermore, examples of tacky/adhesive agent components that can be used include polyesters (polyester type tacky/adhesive agents), urethane resins (urethane type tacky/adhesive agents), and components composed of acrylic resins or the like. In particular, acrylic resins (acrylic type tacky/adhesive agents) are particularly preferred. Acrylic resins (acrylic-type tacky/adhesive agents) have an especially high affinity for the constituent materials of the abovementioned glass fiber sheet 2 and the constituent materials of the second part. Accordingly, the adhesion of the first part to the glass fiber sheet 2 and second part can be made especially high. As a result, the adhesion between the glass fiber sheet 2 and the first film 3 can also be made especially high. Furthermore, acrylic resins (acrylic type tacky/adhesive agents) have especially high light resistance and chemical resistance, and the durability of the timepiece dial 1 as a whole can be improved. ABS resins have especially high chemical resistance, and the durability of the timepiece dial 1 as a whole can be improved. Furthermore, in the manufacture of the timepiece dial 1, the tacky/adhesive agent component can be used in any form, such as a liquid tacky/adhesive agent, tacky/adhesive sheet, tacky/adhesive tape, tape that bonds under heating and pressing, or the like.

Furthermore, polycarbonates are relatively inexpensive plastic materials and can contribute to a further reduction in the production cost of the timepiece dial. Moreover, acrylic resins have especially high light resistance and chemical resistance and can improve the durability of the timepiece dial 1 as a whole. ABS resins have especially high chemical resistance and can further improve the durability of the timepiece dial 1 as a whole.

The first film 3 may also contain components other than those described above. Examples of such components include plasticizers, oxidation inhibitors, coloring agents (including various types of color generating agents, pigments, dyes, fluorescent substances, phosphorescent substances, and the like), lustering agents, fillers, and the like.

There are no particular restrictions on the refractive index of the constituent materials of the first film 3. However, a refractive index of 1.35 to 1.7 is preferable, and a refractive index of 1.45 to 1.6 is more preferable.

Furthermore, the first film 3 may be a film in which the composition is substantially uniform in all parts, or may be a film in which the composition varies according to the position. For example, the first film 3 may have a base part and a surface layer that is disposed on top of this base part. As a result of the first film 3 having such a construction, for example, the adhesion of the first film 3 to the glass fiber sheet 2 can be further improved while the shape stability, mechanical strength, and the like of the timepiece dial 1 as a whole are kept at a particularly high level.

Furthermore, there are no particular restrictions on the thickness of the first film 3. However, a thickness of 50 to 300 μm is preferable, a thickness of 100 to 280 μm is more preferable, and a thickness of 150 to 280 μm is even more preferable. If the thickness of the first film 3 is a value within the abovementioned range, the aesthetic appearance and durability of the timepiece dial 1 can be made particularly good while maintaining a sufficiently high transmissivity of the timepiece dial 1 with respect to electromagnetic waves (radio waves, light). Furthermore, for example, if the thickness of the first film 3 is a value within the abovementioned range, the function of the first film 3 as a substrate (base part) that supports the glass fiber sheet 2 and second film 4 in the timepiece dial 1 can be adequately displayed. On the other hand, if the thickness of the first film 3 is less than the abovementioned lower limit value, there is a possibility that it may become difficult to keep the mechanical strength, shape stability, and the like of the timepiece dial 1 at a sufficiently high level, and there is a possibility that it may become difficult to make the timepiece dial 1 sufficiently durable. Meanwhile, if the thickness of the first film 3 exceeds the abovementioned upper limit value, depending on the constituent materials of the first film 3, there is a possibility that it may become difficult to keep the aesthetic appearance of the timepiece dial 1 at a sufficiently high level. Furthermore, if the thickness of the first film 3 exceeds the abovementioned upper limit value, depending on the constituent materials and other parameters of the first film 3, there is a possibility that the internal stress of the first film 3 will be increased and the shape stability of the timepiece dial 1 will be compromised.

Furthermore, in cases where the first film 3 has the abovementioned first part and second part (e.g., is a laminate, graded material, or the like), there are no particular restrictions on the thickness of the first part. However, a thickness of 1 to 125 μm is preferable, a thickness of 5 to 100 μm is more preferable, and a thickness of 7 to 80 μm is even more preferable. Furthermore, there are no particular restrictions on the thickness of the second part. However, this thickness is preferably 49 to 240 μm, more preferably 85 to 220 μm, and even more preferably 95 to 210 μm. If such conditions are satisfied, the abovementioned effects can be displayed even more prominently.

All or part of the first film 3 may penetrate into the interior of the glass fiber sheet 2. For example, substantially all of the first film 3 in the direction of thickness may penetrate into interior of the glass fiber sheet 2. However, in the construction shown in the figures, the first film 3 has a portion that does not penetrate into the interior of the glass fiber sheet 2. The dial is thereby made flat, and an effect is obtained whereby typesetting, printing, coating, and other types of design techniques are facilitated.

[Second Film]

The second film 4 may be composed of any type of material. However, it is preferable that this film be composed of a material having high transparency (e.g., a material with a transmissivity of 60% or greater with respect to visible light). In particular, it is especially preferable that this film be composed of organic polymer materials such as various types of plastics or the like. As a result, the transmissivity with respect to electromagnetic waves (radio waves, light) can be made especially high while the aesthetic appearance of the timepiece dial 1 is kept at a sufficiently high level. Furthermore, the adhesion between the second film 4 and glass fiber sheet 2 can be made especially high, and the durability of the timepiece dial 1 can also be made especially high.

Various types of thermoplastic resins and various types of thermosetting resins may be cited as examples of organic polymers that can be used to form the second film 4. Examples of such polymers include polyolefins such as polyethylenes, polypropylenes, ethylene-propylene copolymers, ethylene-vinyl acetate copolymers (EVA), and the like; cyclic polyolefins; modified polyolefins; polyvinyl chlorides; polyvinylidene chlorides; polystyrenes; polyamides (e.g., nylon 6, nylon 46, nylon 66, nylon 610, nylon 612, nylon 11, nylon 12, nylon 6-12, nylon 6-66); polyimides; polyimide-imide; polycarbonates (PC); poly-(4-methylpentene-1); ionomers; acrylic resins; polymethyl methacrylates; acrylonitrile-butadiene-styrene copolymers (ABS resins); acrylonitrile-styrene copolymers (AS resins); butadiene-styrene copolymers; polyoxymethylene; polyvinyl alcohols (PVA); ethylene-vinyl alcohol copolymers (EVOH); polyethylene terephthalates (PET), polybutylene terephthalates (PBT), polycyclohexane terephthalates (PCT), and other polyesters; polyethers; polyether ketones (PEK); polyether ether ketones PEEK); polyether imides; polyacetals (POM); polyphenylene oxides; modified polyphenylene oxides; polysulfones; polyethersulfones; polyphenylene sulfides; polyallylates; aromatic polyesters (liquid crystal polymers); polytetrafluoroethylenes, polyvinylidene fluorides, and other fluororesins; various types of thermoplastic elastomers such as styrene type, polyolefin type, polyvinyl chloride type, polyurethane type, polyester type, polyamide type, polybutadiene type, trans-polyisoprene type, fluororubber type, chlorinated polyethylene type, and the like; epoxy resins; phenol resins; urea resins; melamine resins; unsaturated polyesters; silicone resins; urethane resins; poly-p-xylylene resins such as poly-p-xylylene, poly-monochloro-p-xylylene, poly-dichloro-p-xylylene, poly-monofluoro-p-xylylene, poly-monoethyl-p-xylylene, and the like; and copolymers, blends, polymer alloys, and the like composed chiefly of these polymers.

Among these, single polymers, or combinations of two or more polymers (e.g., as blended resins, polymer alloys, or the like) can be used.

Furthermore, the second film 4 may be a laminate having a plurality of layers, or a material whose composition successively varies in the direction of thickness (graded material). As a result of the second film 4 having such a construction, for example, the advantages of a plurality of different types of materials constituting the second film 4 can be obtained more effectively. In more concrete terms, for example, a combination of a material constituting a portion (third part) that penetrates into the glass fiber sheet 2 and a material constituting a portion (fourth part) that does not penetrate into the glass fiber sheet 2 can be selected for the second film 4. In this case, the durability (shape stability, mechanical strength, and the like) of the timepiece dial 1 can be made especially high while the second film 4 is kept sufficiently adhesive in relation to the glass fiber sheet 2.

In cases where the second film 4 has the abovementioned construction (laminate or graded material), it is preferable that the region (third part) that penetrates into the glass fiber sheet 2 be composed of a material containing a tacky/adhesive agent component (tackifying agent or adhesive agent), and that the region (third part) that is located further toward the outside surface than the abovementioned region be composed of a material containing at least one substance selected from the group consisting of polycarbonates (PC), acrylic resins, and acrylonitrile-butadiene-styrene copolymers (ABS resins). If the second film 4 is composed of such a material, the abovementioned effects can be displayed even more prominently.

Furthermore, examples of tacky/adhesive agent components that can be used include polyesters (polyester type tacky/adhesive agents), urethane resins (urethane type tacky/adhesive agents), and components composed of acrylic resins or the like. In particular, acrylic resins (acrylic type tacky/adhesive agents) are particularly preferred. Acrylic resins (acrylic type tacky/adhesive agents) have an especially high affinity for the constituent materials of the abovementioned glass fiber sheet 2 and the constituent materials of the fourth part. Accordingly, the adhesion of the third part to the glass fiber sheet 2 and fourth part can be made especially high. As a result, the adhesion between the glass fiber sheet 2 and the second film 4 can also be made especially high. Furthermore, acrylic resins (acrylic type tacky/adhesive agents) have an especially high light resistance and chemical resistance, and the durability of the timepiece dial 1 as a whole can be improved. ABS resins have an especially high chemical resistance, and the durability of the timepiece dial 1 as a whole can be improved. Furthermore, in the manufacture of the timepiece dial 1, the tacky/adhesive agent component can be used in any form, such as a liquid tacky/adhesive agent, tacky/adhesive sheet, tacky/adhesive tape, tape that bonds under heating and pressing, or the like.

Furthermore, polycarbonates are relatively inexpensive as plastic materials and can contribute to a further reduction in the production cost of the timepiece dial. Moreover, acrylic resins have especially high light resistance and chemical resistance and can improve the durability of the timepiece dial 1 as a whole. ABS resins have especially high chemical resistance and can further improve the durability of the timepiece dial 1 as a whole.

The second film 4 may also contain components other than those described above. Examples of such components include plasticizers, oxidation inhibitors, coloring agents (including various types of color generating agents, pigments, dyes, fluorescent substances, phosphorescent substances, and the like), lustering agents, fillers, and the like.

There are no particular restrictions on the refractive index of the constituent materials of the second film 4. However, a refractive index of 1.35 to 1.7 is preferable, and a refractive index of 1.45 to 1.6 is more preferable.

Furthermore, the second film 4 may be a film in which the composition is substantially uniform in all parts, or may be a film in which the composition varies according to the position. For example, the second film 4 may have a base part and a surface layer that is disposed on top of this base part. As a result of the second film 4 having such a construction, for example, the adhesion of the second film 4 to the glass fiber sheet 2 can be further improved while the shape stability, mechanical strength, and the like of the timepiece dial 1 as a whole are kept at a particularly high level.

Furthermore, there are no particular restrictions on the thickness of the second film 4. However, a thickness of 50 to 300 μm is preferable, a thickness of 100 to 280 μm is more preferable, and a thickness of 150 to 280 μm is even more preferable. If the thickness of the second film 4 is a value within the abovementioned range, the aesthetic appearance and durability of the timepiece dial 1 can be made especially good while maintaining a sufficiently high transmissivity of the timepiece dial 1 with respect to electromagnetic waves (radio waves, light). On the other hand, if the thickness of the second film 4 is less than the abovementioned lower limit value, there is a possibility that it may become difficult to keep the mechanical strength, shape stability, and the like of the timepiece dial 1 at a sufficiently high level, and there is a possibility that it may become difficult to make the timepiece dial 1 sufficiently durable. Meanwhile, if the thickness of the second film 4 exceeds the abovementioned upper limit value, depending on the constituent materials of the second film 4, there is a possibility that it may become difficult to keep the aesthetic appearance of the timepiece dial I at a sufficiently high level. Furthermore, if the thickness of the second film 4 exceeds the abovementioned upper limit value, depending on the constituent materials and other parameters of the second film 4, there is a possibility that the internal stress of the second film 4 will be increased and the shape stability of the timepiece dial 1 will be compromised.

Furthermore, in cases where the second film 4 has the abovementioned third part and fourth part (e.g., is a laminate, graded material, or the like), there are no particular restrictions on the thickness of the third part. However, a thickness of 1 to 125 μm is preferable, a thickness of 5 to 100 μm is more preferable, and a thickness of 7 to 80 μm is even more preferable. Furthermore, there are no particular restrictions on the thickness of the fourth part. However, this thickness is preferably 40 to 240 μm, more preferably 50 to 220 μm, and even more preferably 70 to 210 μm. If such conditions are satisfied, the abovementioned effects can be displayed even more prominently.

All or part of the second film 4 may penetrate into the interior of the glass fiber sheet 2. For example, substantially all of the second film 4 in the direction of thickness may penetrate into interior of the glass fiber sheet 2. However, in the construction shown in the figures, the second film 4 has a portion that does not penetrate into the interior of the glass fiber sheet 2. Treatments such as printing, typesetting (mounting of hour numerals), affixing of the hour numerals, and the like can be performed easily and reliably on the side of the timepiece dial 1 on which the second film 4 is disposed.

There are no particular restrictions on the thickness of the abovementioned timepiece dial 1. However, a thickness of 300 to 700 μm is preferable, a thickness of 450 to 700 μm is more preferable, a thickness of 480 to 600 μm is even more preferable, and a thickness of 480 to 520 μm is most preferable. If the thickness of the timepiece dial 1 is a value within the abovementioned range, the aesthetic appearance and durability of the timepiece dial 1 can be made especially good while sufficiently high transmissivity is maintained with respect to electromagnetic waves (radio waves, light). When a timepiece is manufactured, this manufacture can be accomplished without narrowing the degree of freedom in selecting the thickness of the timepiece.

It is preferable that the transmissivity of the timepiece dial 1 with respect to light be 20% or greater. A transmissivity of 22 to 50% is more preferred, and a transmissivity of 25 to 40% is even more preferred.

Thus, the timepiece dial 1 has an excellent aesthetic appearance and is superior in terms of transmissivity with respect to electromagnetic waves. Accordingly, the timepiece dial 1 can be appropriately used in radio-controlled timepieces, solar timepieces (timepieces containing a solar cell), radio-controlled solar timepieces, and the like.

Furthermore, the timepiece dial 1 may also be composed of a material containing a coloring agent. As was described above, the timepiece dial has a glass fiber sheet 2. The glass material that constitutes the glass fibers is itself inherently colorless, so that the glass fiber sheet composed of this glass material shows a white color (with a lustrous feel). Accordingly, by using coloring agents, it is possible to provide timepiece dials 1 with a broad range of color variations. Such coloring agents may be contained in any part of the timepiece dial 1. For example, coloring agents may be contained as components of the glass fiber sheet 2, as components of the first film 3, or as components of the second film 4.

In the above description, the timepiece dial was described as a part composed of a glass fiber sheet, a first film, and a second film. However, the timepiece dial 1 may also have further components besides these components. For example, the timepiece dial of the present invention may have a coating layer on top of the second film (on the side opposite from the side that faces the first film). As a result, for example, various characteristics of the timepiece dial as a whole, such as the weather resistance, water resistance, oil resistance, scratch resistance, wear resistance, resistance to discoloration, and the like, can be improved. Consequently, the durability of the timepiece dial can be made especially high. For example, such a coating layer may also be disposed on top of the first film (on the side opposite from the side that faces the first film).

For example, the timepiece dial 1 described above can be manufactured by pressing, heating, heating under pressure, or the like in a state in which the first film 3, glass fiber sheet 2, and second film 4 are superimposed in that order. Alternatively, this timepiece dial 1 can also be manufactured by joining the glass fiber sheet 2 and one of the films (first film 3 or second film 4), and then joining the other film (second film 4 or first film 3) on the opposite side of the glass fiber sheet 2 from the side on which the abovementioned film has been joined. Furthermore, the thicknesses and other parameters of the first region 23 and second region 24 can be set at the desired values by adjusting the pressing pressure, heating temperature, and the like.

Furthermore, in the case of manufacture by the abovementioned method, it is preferable that the first film 3 used in this manufacture have higher rigidity than the glass fiber sheet 2. As a result, the shape stability and other parameters of the timepiece dial 1 can be made especially high. Furthermore, in cases where a laminate such as that described above is used as the first film 3, it is preferable that the second part (second layer) of the first film 3 have higher rigidity than the glass fiber sheet 2. As a result, the shape stability and other properties of the timepiece dial 1 can be made especially high while the abovementioned effects can be adequately displayed.

Furthermore, in the case of manufacture by the abovementioned method, it is preferable that the second film 4 used in this manufacture have higher rigidity than the glass fiber sheet 2. As a result, the shape stability and other properties of the timepiece dial 1 can be made especially good. Furthermore, in cases where a laminate such as that described above is used as the second film 4, it is preferable that the fourth part (second layer) of the second film 4 have higher rigidity than the glass fiber sheet 2. As a result, the shape stability and other properties of the timepiece dial 1 can be made especially good while the abovementioned effects can be adequately displayed.

<Timepiece>

Next, the timepiece of the present invention equipped with the abovementioned timepiece dial of the present invention will be described.

The timepiece of the present invention is a timepiece which has the abovementioned timepiece dial of the present invention. As was described above, the timepiece dial of the present invention is superior in terms of both light transmissivity (transmissivity with respect to electromagnetic waves) and decorative characteristics (aesthetic appearance). Accordingly, the timepiece of the present invention equipped with such a timepiece dial can adequately satisfy the conditions required in solar timepieces and radio-controlled timepieces. Furthermore, universally known parts can be used as the parts other than the timepiece dial that constitutes the timepiece of the present invention (i.e., the timepiece dial of the present invention). One example of the construction of the timepiece of the present invention will be described below.

Figure 2:
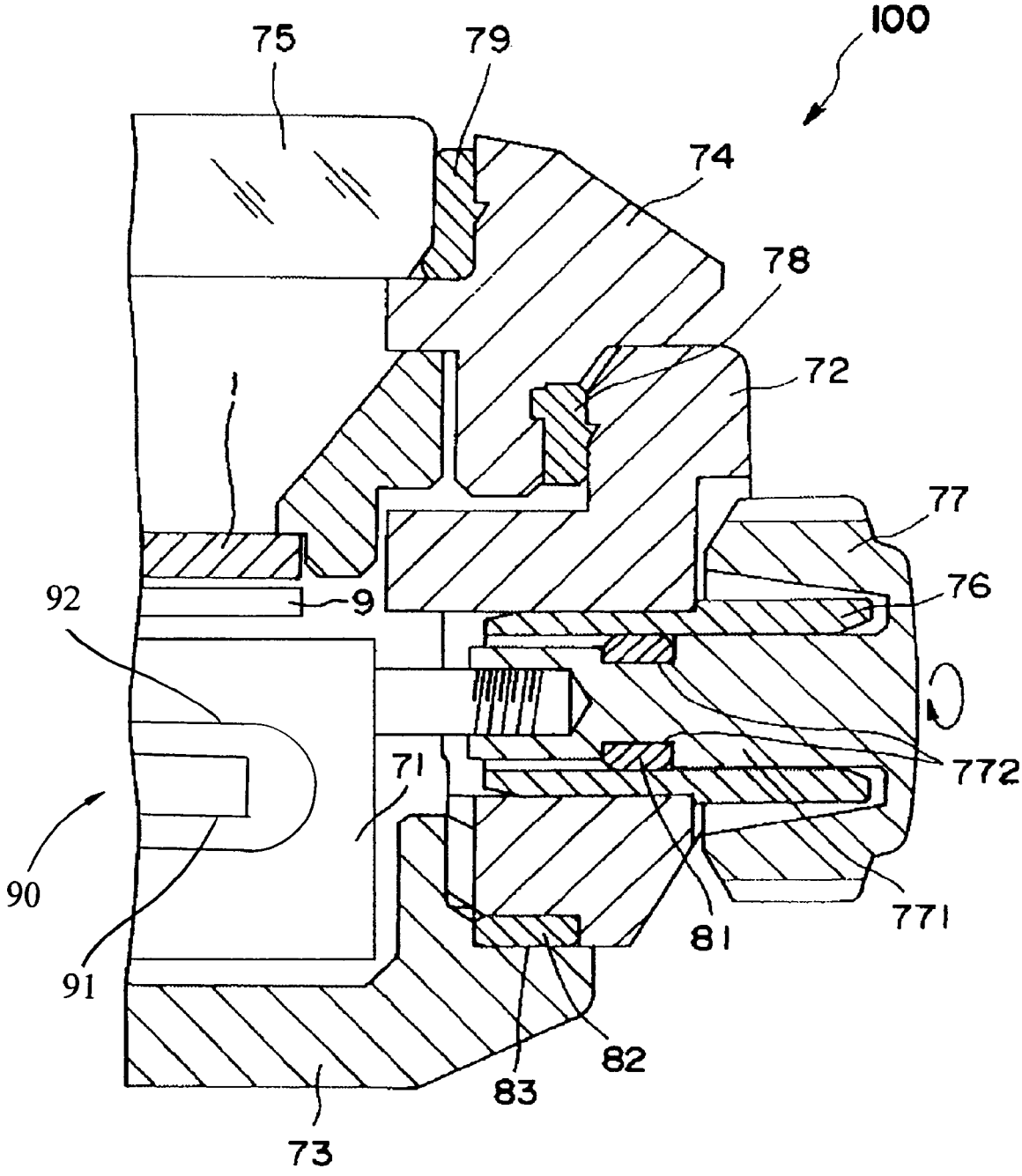
FIG. 2 is a partial sectional view showing a preferred embodiment of the timepiece (portable timepiece) of the present invention.

FIG. 2 is a sectional view showing a preferred embodiment of the timepiece (wristwatch) of the present invention.

As is shown in FIG. 2, the wristwatch (timepiece) 100 of the present embodiment has a case 72, a back cover 73, a bezel 74, and a glass plate (cover glass) 75. Furthermore, the timepiece dial 1 of the present invention described above, a solar cell 9, an antenna (electromagnetic wave receiver) 90 having a core 91 and a coil 92, and a movement 71 are accommodated inside the case 72. Moreover, hands (indicator hands) and other parts not shown in the figures are also accommodated.

The glass plate 75 is ordinarily composed of highly transparent glass, sapphire, or the like. As a result, the beauty of the timepiece dial 1 of the present invention can be adequately displayed, and a sufficient quantity of light can be directed to the solar cell 9.

The movement 71 drives the indicator hands by using the electromotive force of the solar cell 9.

Although this is not shown in FIG. 2, the movement 71 includes, for example, an electrical double layer capacitor or lithium ion secondary cell which stores the electromotive force of the solar cell 9, a quartz crystal vibrator used as a time reference source, a semiconductor integrated circuit which generates a driving pulse that drives the timepiece on the basis of the oscillation frequency of the quartz crystal vibrator, a stepping motor which receives this driving pulse and drives the indicator hands one second at a time, a wheel train mechanism which transmits the motion of the stepping motor to the indicator hands, and the like.

Furthermore, the movement 71 has an antenna (not shown in the figures) that is used to receive electromagnetic waves.

The movement also has a function whereby time adjustment and the like are performed using the received electromagnetic waves.

The solar cell (generator) 9 has a function which converts light energy into electrical energy. Furthermore, the electrical energy produced by the conversion in the solar cell 9 is utilized for the driving of the movement and the like.

For example, the solar cell 9 has a p-i-n structure in which p-type impurities and n-type impurities are selectively introduced into a non-single-crystal silicon thin film, and an i-type non-single-crystal silicon thin film having a low impurity concentration is disposed between the p-type non-single-crystal silicon thin film and the n-type non-single-crystal silicon thin film.

A setting stem pipe 76 is fitted and fastened in the case 72, and the shaft part 771 of a watch stem 77 is rotatably inserted into this setting stem pipe 76.

The case 72 and bezel 74 are fastened by means of a plastic gasket 78, and the bezel 74 and plastic plate 75 are fastened by means of a plastic gasket 79.

Furthermore, a back cover 73 is engaged with (or screwed into) the case 72, and an annular rubber gasket (back cover gasket) 82 is interposed in a compressed state in the joint (seal) 83 between these parts. The seal 83 is sealed in a liquid-tight manner by this construction, and a waterproof function is obtained.

A groove 772 is formed in the outer circumference of the shaft part 771 of the watch stem 77 at an intermediate point on this shaft part 771, and a annular rubber gasket (watch stem gasket) 81 is fitted inside this groove 772. The rubber gasket 81 adheres tightly to the inner circumferential surface of the setting stem pipe 76, and is compressed between this inner circumferential surface and the inside surfaces of the groove 772. The watch stem 77 and setting stem pipe 76 are sealed in a liquid-tight manner by this construction, and a waterproof function is obtained. Furthermore, when the watch stem 77 is rotationally operated, the rubber gasket 81 rotates together with the shaft part 771 and performs a rubbing motion in the circumferential direction while adhering tightly to the inner circumferential surface of the setting stem pipe 76.

In the above description, a wristwatch (portable timepiece) constituting a radio-controlled solar timepiece was described as one example of a timepiece. However, the present invention can also be similarly used in other types of timepieces, such as portable timepieces other than wristwatches, as well as tabletop timepieces, wall clocks, and the like. The present invention can also be applied to all types of timepieces, such as solar timepieces other than radio-controlled solar timepieces, radio-controlled timepieces other than radio-controlled solar timepieces, and the like.

Furthermore, a preferred embodiment of the present invention was described above. However, the present invention is not limited to such an embodiment.

For example, in the timepiece dial and timepiece of the present invention, the constructions of various parts may be replaced by arbitrary constructions that exhibit similar functions, and other arbitrary constructions may also be added.

Furthermore, the glass fiber sheet may also have regions other than the abovementioned first region, second region, and third region.

Figure 3:
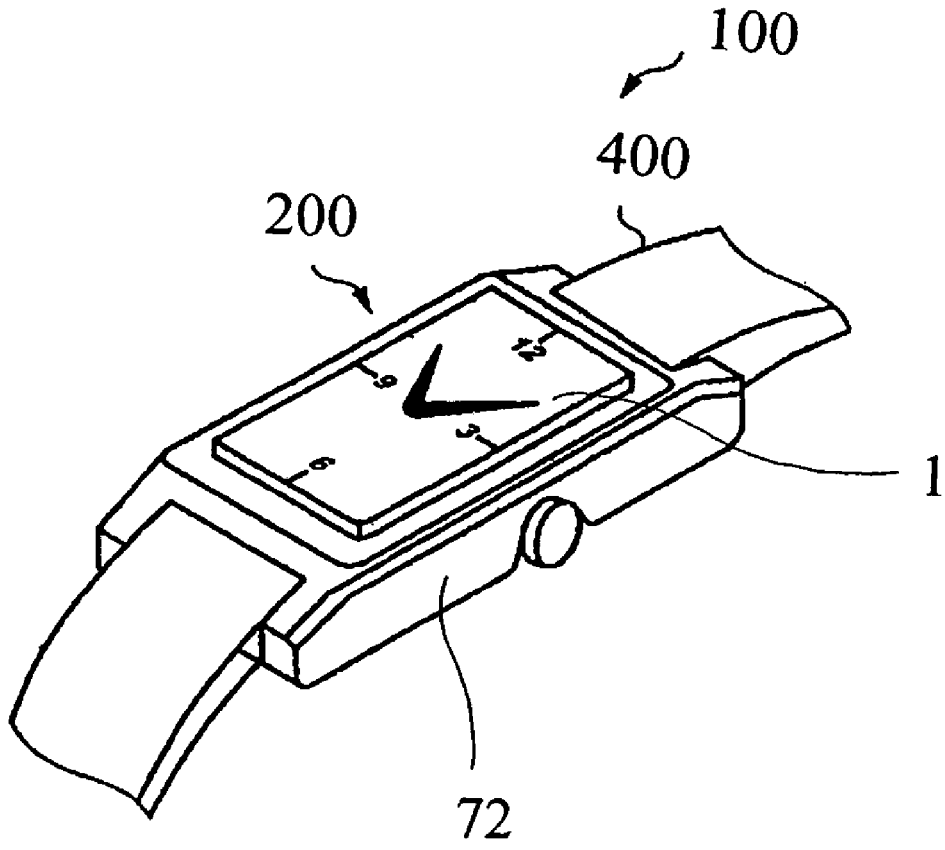
FIG. 3 is a perspective view showing the external appearance of the timepiece of the present invention.

Furthermore, in the abovementioned embodiment, the third region was described as a region that was disposed over the entire glass fiber sheet in the planar direction (direction of the principal faces). However, it is sufficient if this region is disposed on at least a portion of the glass fiber sheet in the planar direction, and it is not necessary to dispose this region over the entire surface (entire principal face) of the glass fiber sheet. In other words, for example, the glass fiber sheet may have regions into which the first film and/or second film penetrate over a portion of the sheet in the planar direction across the entire sheet in the direction of thickness FIG. 3 is a perspective view showing the external appearance of the timepiece of the present invention.

The time piece has a case 72 that stores a time display part 200 and is connected to a band 400 for users to wear the timepiece.

WORKING EXAMPLES

Next, concrete working examples of the present invention will be described.

1. Manufacture of Timepiece Dial

Working Example 1

A timepiece dial was manufactured by the method indicated below.

First, a glass fiber sheet composed of glass fibers, a first film, and a second film were prepared. The prepared glass fiber sheet, first film, and second film all had a size of 50 cm (length)×50 cm (width).

[Glass Fiber Sheet]

The glass fiber sheet was composed of a woven material in which glass fiber bundles formed by bundling approximately 200 glass fibers in each bundle were woven in a flat weave. The glass fibers constituting the glass fiber sheet were composed of soda glass (refractive index (absolute refractive index): 1.56); the thickness of these glass fibers was 6 μm. Furthermore, the thickness of the glass fiber sheet was 200 μm, and the surface density was 220 g/m$^2$.

[First Film]

The first film was manufactured as a laminate that had a first part (first layer) composed of an acrylic resin (acrylic type tacky/adhesive agent), and a second part (second layer) composed of a polycarbonate (refractive index (absolute refractive index): 1.58). The thickness (total thickness) of the first film was 150 μm, the thickness of the first part was 10 μm, and the thickness of the second part was 140 μm. Furthermore, the transmissivity of the first film with respect to visible light was 90% or greater. Furthermore, the second part (second layer) had higher rigidity than the abovementioned glass fiber sheet, and the rigidity of the first film as a whole was also higher than the rigidity of the abovementioned glass fiber sheet.

[Second Film]

The second film was manufactured as a laminate that had a third part (first layer) composed of an acrylic resin (acrylic type tacky/adhesive agent), and a fourth part (second layer) composed of a polycarbonate (refractive index (absolute refractive index): 1.58). The thickness (total thickness) of the second film was 150 μm, the thickness of the third part was 10 μm, and the thickness of the fourth part was 140 μm. Furthermore, the transmissivity of the second film with respect to visible light was 90% or greater. Furthermore, the fourth part (second layer) had higher rigidity than the abovementioned glass fiber sheet, and the rigidity of the second film as a whole was also higher than the rigidity of the abovementioned glass fiber sheet.

[Joining of First Film, Glass Fiber Sheet and Second Film]

Next, the abovementioned first film, glass fiber sheet, and second film were superimposed in that order on a stand having a flat surface. In this case, the first film was disposed so that the first part contacted the glass fiber sheet. Furthermore, the second film was disposed so that the third part contacted the glass fiber sheet.

Next, the combined superimposed first film, glass fiber sheet, and second film were pressed with a pressure of 0.5 MPa in the direction perpendicular to the planar direction of the abovementioned parts. This pressing was performed at room temperature, and heating was not performed. As a result, one portion of the first film (i.e., part of the first part) penetrated into the interior of the glass fiber sheet and formed a first region, and one portion of the second film (i.e., part of the third part) penetrated into the interior of the glass fiber sheet and formed a second region. The thickness of the fist region that was formed was 5 μm, and the thickness of the second region was 5 μm. Furthermore, the thickness of the third region of the glass fiber sheet, penetrated neither by the first film nor by second film, was 190 μm.

Subsequently, numerous timepiece dials having a substantially elliptical shape were manufactured by stamp molding from a joined assembly of the first film, glass fiber sheet, and second film. The timepiece dials thus obtained had a length of 40 mm in the direction of the minor axis, and a length of 55 mm in the direction of the major axis.

Working Example 2

A timepiece dial was manufactured in the same manner as in Working Example 1 except for the fact that films composed of simple polycarbonates (not laminated bodies) were used as the first film and second film, the temperature during the pressing of the assembly of the superimposed first film, glass fiber sheet, and second film was set at 200° C., and the pressure was set at 3 MPa.

Working Examples 3 Through 8

A timepiece dial was manufactured in the same manner as in Working Example 1 except for the fact that the constitutions of the glass fiber sheet, first film, and second film were set as shown in Table 1, and the pressure and temperature conditions in the process (joining process) of joining the first film, glass fiber sheet, and second film were set as shown in Table 1.

Working Example 9

A timepiece dial was manufactured in the same manner as in the abovementioned Working Example 1 except for the fact that the first film was a laminate in which a layer composed of an acrylic resin (acrylic type tacky/adhesive agent), a layer composed of a polycarbonate (refractive index (absolute refractive index): 1.58), and a layer (coloring layer) composed of a mixture of a urethane resin and a white pigment were laminated in that order.

Comparative Example 1

A timepiece dial was manufactured in the same manner as in the abovementioned Working Example 1 except for the fact that the glass fiber sheet was shaped by stamping without being covered by a first film or second film.

Comparative Example 2

A timepiece dial was manufactured in the same manner as in the abovementioned Working Example 1 except for the fact that a joined assembly of the glass fiber sheet and second film was formed without using the first film, and this joined assembly was shaped by stamping.

Comparative Example 3

A timepiece dial was manufactured in the same manner as in the abovementioned Working Example 1 except for the fact that a joined assembly of the glass fiber sheet and first film was formed without using the second film, and this joined assembly was shaped by stamping.

Comparative Example 4

First, a glass fiber sheet similar to that used in the abovementioned Working Example 1 was prepared.

Next, this glass fiber sheet was impregnated with a solution of a urethane resin (solvent: thinner). Subsequently, the solvent was removed from the impregnating solution, and a tabular member was obtained in which the gaps in the glass fiber sheet were substantially completely filled with a urethane resin. Subsequently, this tabular member was shaped by stamping in the same manner as in the abovementioned Working Example 1, thus producing a timepiece dial.

Comparative Example 5

A first film (thickness: 150 μm) composed of a polycarbonate, a second film (thickness: 150 μm) composed of a polycarbonate, and a glass fiber sheet similar to that used in the abovementioned Working Example 1 were prepared.

An adhesive agent was applied to one surface of the first film, the glass fiber sheet was then placed on this surface, and the adhesive agent was solidified in this state.

Subsequently, an adhesive agent was applied to one side of the second film; then, the glass fiber sheet to which the first film had been bonded was placed on this surface, and the adhesive agent was solidified in this state. In this case, the second film was bonded to the opposite side of the glass fiber sheet from the side to which the first film was boded.

In the joined assembly (bonded assembly) thus obtained, the adhesive agent was applied only to the surfaces of the glass fiber sheet and did not penetrate into the interior of the glass fiber sheet.

Subsequently, a timepiece dial was obtained by stamping the joined assembly (boded assembly) in the same manner as in the abovementioned Working Example 1.

The constitution of the timepiece dial and the conditions of the joining process are shown for the respective working examples and respective comparative examples in Table 1. Furthermore, in Table 1, polycarbonate is indicated as PC, and urethane resin is indicated as PU.

TABLE 1

(Part 1)

| | Joining process | | Timepiece dial Glass fiber sheet | | | | | | | |
|---|---|---|---|---|---|---|---|---|---|---|
| | | | Constituent material | | Glass fibers | | Surface | First film | Second film | Third film |
| | Temperature (° C.) | Pressure (MPa) | | Refractive Index | Thickness (μm) | Thickness (μm) | density (g/m$^2$) | thickness (μm) | thickness (μm) | thickness (μm) |
| WE1 | 20 | 0.5 | Soda glass | 1.56 | 6 | 200 | 220 | 5 | 5 | 190 |
| WE2 | 200 | 3 | Soda glass | 1.56 | 6 | 200 | 220 | 10 | 10 | 180 |
| WE3 | 200 | 3 | Soda glass | 1.56 | 1 | 40 | 25 | 10 | 10 | 20 |
| WE4 | 220 | 3 | Soda glass | 1.56 | 6 | 200 | 220 | 90 | 90 | 20 |
| WE5 | 200 | 3 | Soda glass | 1.56 | 20 | 100 | 250 | 10 | 10 | 80 |
| WE6 | 200 | 3 | Soda glass | 1.56 | 2 | 100 | 150 | 10 | 10 | 80 |
| WE7 | 200 | 3 | Soda glass | 1.56 | 8 | 400 | 400 | 10 | 10 | 380 |
| WE8 | 160 | 3 | Soda glass | 1.56 | 6 | 200 | 220 | 0.1 | 0.1 | 199.8 |
| WE9 | 20 | 0.5 | Soda glass | 1.56 | 6 | 200 | 220 | 5 | 5 | 190 |
| CE1 | — | — | Soda glass | 1.56 | 6 | 200 | 220 | — | — | 200 |
| CE2 | 20 | 3 | Soda glass | 1.56 | 6 | 200 | 220 | — | 10 | 190 |
| CE3 | 20 | 3 | Soda glass | 1.56 | 6 | 200 | 220 | 10 | — | 190 |
| CE4 | 80 | 0 | Soda glass | 1.56 | 6 | 200 | 220 | 100 | 100 | 0 |
| CE5 | 20 | 0 | Soda glass | 1.56 | 6 | 200 | 220 | 0 | 0 | 200 |

(Part 2)

| | Timepiece dial | | | | | | | | |
|---|---|---|---|---|---|---|---|---|---|
| | First film | | | | Second film | | | | |
| | Constitution | | | Visible light | Constitution | | | Visible light | |
| | | Refractive index | Thickness (μm) | transmissivity (%) | | Refractive index | Thickness (μm) | transmissivity (%) | Thickness (μm) |
| WE1 | PC/tacky/ adhesive; layer | 1.58 | 150 | 90 | PC/tacky/ adhesive layer | 1.58 | 150 | 90 | 500 |
| WE2 | PC | 1.58 | 150 | 90 | PC | 1.58 | 150 | 90 | 500 |
| WE3 | PC | 1.58 | 230 | 90 | PC | 1.58 | 230 | 90 | 500 |
| WE4 | PC | 1.58 | 150 | 90 | PC | 1.58 | 150 | 90 | 500 |
| WE5 | PC | 1.58 | 200 | 90 | PC | 1.58 | 200 | 90 | 500 |
| WE6 | PC | 1.58 | 300 | 90 | PC | 1.58 | 100 | 90 | 500 |
| WE7 | PC | 1.58 | 50 | 90 | PC | 1.58 | 50 | 90 | 500 |
| WE8 | PC | 1.58 | 150 | 90 | PC | 1.58 | 150 | 90 | 500 |
| WE9 | Coloring layer/PC/ tacky/ adhesive layer | 1.58 | 150 | 90 | PC/tacky/ adhesive layer | 1.58 | 150 | 90 | 500 |
| CE1 | — | — | — | — | — | — | — | — | 200 |
| CE2 | — | — | — | — | PC | 1.58 | 150 | 90 | 350 |
| CE3 | PC | 1.58 | 150 | 90 | — | — | — | — | 350 |
| CE4 | PU | 1.54 | 150 | 87 | PU | 1.54 | 150 | 87 | 500 |
| CE5 | PC/tacky/ adhesive layer | 1.58 | 150 | 90 | PC/tacky/ adhesive layer | 1.58 | 150 | 90 | 500 |

[WE = working example, CE = comparative example]

2. Evaluation of External Appearance of Timepiece Dial

The timepiece dials manufactured in the respective working examples and respective comparative examples described above were observed visually and under a microscope, and the external appearance was evaluated according to the following four criteria.

◎: Superior external appearance

O: Good external appearance

Δ: Somewhat poor external appearance x: Poor external appearance

3. Evaluation of Shape Stability

The shape stability of the timepiece dials of the respective working example and respective comparative examples described above was evaluated using the following method.

First, test pieces having an elliptical shape in which the length in the direction of the minor axis was 40 mm and the length in the direction of the major axis was 55 mm were prepared for the respective working examples and respective comparative examples.

For these test pieces, a portion 5 mm from one end part in the direction of the major axis (fixing portion) was fixed, and the amount of bending (under the sample's own weight) at a position 50 mm from the fixing portion (i.e., a position located at the other end part in the direction of the major axis) was measured. This amount of bending was evaluated according to the following four evaluation criteria. It may be said that that shape stability improves as the amount of bending decreases.

◎: Amount of bending less than 1 μm

O: Amount of bending equal to or greater than 1 μm, but less than 2 μm

Δ: Amount of bending equal to or greater than 2 μm, but less than 5 μm x: Amount of bending equal to or greater than 5 μm 4. Evaluation of Adhesion of Films (First Film, Second Film)

The two types of tests shown below were performed for the timepiece dials manufactured in the respective working examples and comparative examples described above, and the adhesion of the films (first film, second film) was evaluated.

4-1. Bending Test

The timepiece dials were bent 90° about the center of each timepiece dial using an iron bar with a diameter of 4 mm as a fulcrum. Then, the external appearance of each timepiece dial was observed by visual inspection, and the external appearance was evaluated according to the four evaluation criteria shown below. Bending was performed in both the compressive and tensile directions.

◎: Absolutely no lifting or peeling of the films observed.

O: Almost no lifting of the films observed.

Δ: Lifting of the films clearly visible.

x: Cracking and peeling of the films clearly seen.

4-2 Heat Cycle Test

The respective timepiece dials were subjected to the following heat cycle test.

First, each timepiece dial was allowed to stand for 1.5 hours in an environment at 20° C., then for 2 hours at an environment at 60° C., then for 1.5 hours in an environment at 20° C., and then for 3 hours at an environment at −20° C. The ambient temperature was then again returned to 20° C., and this was taken as one cycle (8 hours). This cycle was repeated a total of 3 times (24 hours).

The external appearance of each timepiece dial was then observed visually, and these observations were evaluated according to the following four evaluation criteria.

◎: Absolutely no lifting or peeling of the films, or deformation or other defects of the timepiece dial, observed.

O: Almost no lifting of the films or deformation of the timepiece dial seen.

Δ: Lifting of the films clearly visible.

x: Cracking and peeling of the films clearly visible. Furthermore, deformation of the timepiece dial clearly seen.

5. Evaluation Regarding Printing

For the timepiece dials manufactured in the respective working examples and respective comparative examples described above, printing was performed on the surface (on the side on which the second film was formed in the case of timepiece dials having a second face), and this printing was evaluated according to the following four evaluation criteria:

◎: Printing was possible, absolutely no problems such as thin spots or the like in the printed parts.

O: Printing was possible; almost no problems such as thin spots or the like were seen in the printed parts.

Δ: Slight adhesion defects were seen in the printed parts that were formed.

x: Pronounced adhesion defects were seen in the printed parts that were formed.

6. Evaluation Regarding Adhesion of Affixed Hour Numerals

In the timepiece dials manufactured in the respective working examples and respective comparative examples described above, hour numerals were affixed to the surface (on the side on which the second film was formed in the case of timepiece dials having a second face), and the results were evaluated according to the following four evaluation criteria:

◎: The hour numerals could be easily affixed, and the adhesion of the affixed hour numerals was also extremely high.

O: The hour numerals could be easily affixed. However, the adhesion of the affixed hour numerals was somewhat low.

Δ: The hour numerals could be easily affixed. However, the adhesion of the affixed hour numerals was low.

x: The hour numerals were difficult to affix, and the adhesion of the affixed hour numerals was also low.

7. Evaluation of Transmissivity of Timepiece Dial with Respect to Light

For the timepiece dials manufactured in the respective working examples and respective comparative examples described above, the transmissivity with respect to light was evaluated by the following method:

First, a solar cell and each of the timepiece dials were placed in a dark room. Next, using the solar cell alone, light from a fluorescent lamp (light source) disposed at a specified distance was directed to the light-receiving surface of this solar cell. In this case, the current generated by the solar cell was taken as A [mA]. Next, in a state in which the timepiece dial was superimposed on the light-receiving surface of the solar cell, light from a fluorescent lamp (light source) disposed at a specified distance was directed to the dial in the same manner as described above. The current generated by the solar cell in this case was taken as B [mA]. Then, the light transmissivity of the timepiece dial expressed by $(B/A)\times 100$ was calculated, and was evaluated according to the following four evaluation criteria. It may be said that the light-transmitting properties of the timepiece dial improve as the light transmissivity of the timepiece dial increase.

◎: 32% or greater

O: 25% or greater, but less than 32%

Δ: 17% or greater, but less than 25% x: Less than 17%

Then, timepieces such as the one shown in FIG. 2 were manufactured using the timepiece dials manufactured in the respective working examples and respective comparative examples described above. In this case, furthermore, the timepiece dials were disposed so that the face on which the second film was formed (face having the affixed hour numerals) was on the outside surface. The respective timepieces thus manufactured were then placed in a dark room. Light from a fluorescent lamp (light source) that was disposed at a specified distance from the surface of the timepiece on the side of the timepiece dial (the surface on the side of the glass plate) was subsequently directed to the timepieces. In this case, the illumination intensity of the light was varied at a fixed rate so that this illumination intensity gradually increased. As a result, in the timepiece of the present invention, the movement was driven even in cases where the relative illumination intensity was low.

8. Evaluation of Electromagnetic Wave Transmissivity

For the timepiece dials manufactured in the respective working examples and respective comparative examples described above, the electromagnetic wave transmissivity was evaluated by the following method.

First, a timepiece case and a wristwatch internal module (movement) equipped with an antenna used to receive electromagnetic waves were prepared.

Next, the wristwatch internal module (movement) and timepiece dial were assembled inside the timepiece case, and the reception sensitivity for electromagnetic waves in this state was measured.

Reception sensitivity measured without the use of the timepiece dial was used as a reference, and the reduction in reception sensitivity (dB) that occurred when the timepiece dial was assembled was evaluated according to the following four evaluation criteria. It may be said that electromagnetic wave transmissivity of the timepiece dial improves with a lower reduction in the reception sensitivity for electromagnetic waves.

◎: No reduction in sensitivity noted (at or below the detection limit)

O: Reduction in sensitivity registered at less than 0.7 dB

Δ: Reduction in sensitivity is 0.7 dB or greater but less than 1.0 dB x: Reduction in sensitivity is 1.0 dB or greater The results are shown in Table 2.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

TABLE 2

| | Evaluation of external appearance | Evaluation of shape stability | Evaluation of film adhesion: Bending test | Evaluation of film adhesion: Heat cycle test | Evaluation with regard to printing | Evaluation of affixed hour numerals | Evaluation of light transmissivity | Evaluation of electromagnetic wave transmissivity |
|---|---|---|---|---|---|---|---|---|
| WE1 | ◎ | ◎ | ◎ | ◎ | ◎ | ◎ | ◎ | ◎ |
| WE2 | ◎ | O | ◎ | ◎ | ◎ | O | O | ◎ |
| WE3 | O | O | O | ◎ | ◎ | ◎ | ◎ | ◎ |
| WE4 | O | ◎ | ◎ | ◎ | ◎ | O | O | ◎ |
| WE5 | O | Δ | Δ | Δ | ◎ | Δ | O | ◎ |
| WE6 | ◎ | Δ | Δ | Δ | ◎ | ◎ | O | ◎ |
| WE7 | ◎ | Δ | Δ | O | ◎ | Δ | Δ | ◎ |
| WE8 | ◎ | Δ | Δ | Δ | ◎ | Δ | O | ◎ |
| WE9 | ◎ | ◎ | ◎ | ◎ | ◎ | ◎ | ◎ | ◎ |
| CE1 | ◎ | x | — | — | x | x | O | ◎ |
| CE2 | O | x | O | O | ◎ | x | O | ◎ |
| CE3 | ◎ | x | O | O | x | x | O | ◎ |
| CE4 | x | Δ | ◎ | ◎ | ◎ | Δ | ◎ | ◎ |
| CE5 | O | x | x | x | ◎ | x | ◎ | ◎ |

[WE = working example, CE = comparative example]

Reception sensitivity measured without the use of the timepiece dial was used as a reference, and the reduction in reception sensitivity (dB) that occurred when the timepiece dial was assembled was evaluated according to the following four evaluation criteria. It may be said that electromagnetic wave transmissivity of the timepiece dial improves with a lower reduction in the reception sensitivity for electromagnetic waves. As is clear from Table 2, the timepiece dial of the present invention has an excellent aesthetic appearance, is also superior in terms of film adhesion and shape stability, and shows high durability. Furthermore, all of the examples of the timepiece dial of the present invention were superior in terms of transmissivity with respect to electromagnetic waves (radio waves, light). On the other hand, satisfactory results were not obtained in the case of the comparative examples.

Timepieces such as the one shown in FIG. 2 were also assembled using the timepiece dials obtained in the respective working examples and respective comparative examples. When the respective timepieces thus obtained were subjected to testing and evaluation in the same manner as described above, similar results were obtained.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

Key to Symbols

1 Timepiece dial, 2 Glass fiber sheet, 21 First face, 22 Second face, 23 First region, 24 Second region, 25 Third region, 3 First film, 4 Second film, 9 Solar cell, 71 Movement, 72 Case, 73 Back cover, 74 Bezel, 75 Glass plate (cover glass), 76 Setting stem pipe, 77 Watch stem, 771 Shaft part, 772 Groove, 78 Plastic gasket, 79 Plastic gasket, 81 Rubber gasket (watch stem gasket), 82 Rubber gasket (back cover gasket), 83 Joining part (seal), 100 Wristwatch (portable timepiece)

What is claimed is:

1. A timepiece dial comprising:

a first film having 60% or more transmissivity to electromagnetic waves, a second film having 60% or more transmissivity to electromagnetic waves, and having a time display face; and a glass fiber sheet being primarily made of glass fibers, being transmissive to electromagnetic waves, having a first region being configured next to said first film, said first film at least partially penetrating said glass fiber sheet, a second region being configured next to said second film, said second film at least partially penetrating said glass fiber sheet, and a third region being configured between said first and second region.

2. The timepiece dial according to claim 1, wherein the thickness of said first film is 50 to 300 μm.

3. The timepiece dial according to claim 2, wherein the thickness of said second film is 50 to 300 μm.

4. The timepiece dial according to claim 3, wherein said first film and said second film are made of a material having color agents.

5. The timepiece dial according to claim 1, wherein said first film includes a first part that penetrates said glass fiber sheet and a second part that does not penetrate to said glass fiber sheet, and said second film includes a third part that penetrates said glass fiber sheet and a fourth part that does not penetrate to said glass fiber sheet.

6. The timepiece dial according to claim 5, wherein said first part is made of a material having an adhesive agent, and said second part is made of a material selected from a group consisting polycarbonates, acrylic resins, and acrylonitrile-butadiene-styrene copolymers.

7. The timepiece dial according to claim 5, wherein said third part is made of a material having an adhesive agent, and said fourth part is made of a material selected from a group consisting polycarbonates, acrylic resins, and acrylonitrile-butadiene-styrene copolymers.

8. The timepiece dial according to claim 1, wherein the thickness of said glass fiber sheet is 30 to 500 μm.

9. The timepiece dial according to claim 8, wherein the thickness of said glass fiber sheet is 80 to 300 μm.

10. The timepiece dial according to claim 6, wherein the thickness of said glass fibers is 1 to 20 μm.

11. The timepiece dial according to claim 10, wherein said glass fiber sheet is made of a material selected from a group consisting of soda glass, crystal glass, quartz glass, lead glass, potassium glass, borosilicate glass, and alkali-free glass.

12. The timepiece dial according to claim 10, wherein said glass fibers are made of a material having color agents.

13. The timepiece dial according to claim 8, wherein the refractive index of said glass fibers is 1.40 to 1.70.

14. The timepiece dial according to claim 8, wherein the surface density of said glass fiber sheet is 20 to 500 $g/m^2$.

15. The timepiece dial according to claim 1, wherein the thickness of said first region is 0.1 to 140 μm.

16. The timepiece dial according to claim 15, wherein the thickness of said second region is 0.1 to 140 μm.

17. The timepiece dial according to claim 16, wherein the thickness of said third region is 5 to 280 μm.

18. A timepiece, comprising:

a movement; and a time display part being connected to said movement, having a timepiece dial, and being configured to show time information on said dial, said timepiece dial having a first film having 60% or more transmissivity to electromagnetic waves, a second film having 60% or more transmissivity to electromagnetic waves, and having a time display face; and a glass fiber sheet being primarily made of glass fibers, being transmissive to electromagnetic waves, having a first region being configured next to said first film, said first film at least partially penetrating said glass fiber sheet, a second region being configured next to said second film, said second film at least partially penetrating said glass fiber sheet, and a third region being configured between said first and second region.

19. The timepiece according to claim 18, further comprising an electromagnetic wave receiver that receives reference time information and corrects said time information based on said reference time information.

20. The timepiece according to claim 18, further comprising a generator that generates power by utilizing light through said timepiece dial and supplies said power to said movement.

21. The timepiece according to claim 18, further comprising a case that stores said movement and said time display part, and a band that is connected to said case to be worn on a body.

* * * * *